US006139066A

United States Patent [19]

Mowry, Jr. et al.

[11] Patent Number: 6,139,066

[45] Date of Patent: Oct. 31, 2000

[54] OPTICALLY DECODABLE SECURITY DOCUMENT

[75] Inventors: William Harvey Mowry, Jr.; Standale Joseph Cull, both of Dayton, Ohio

[73] Assignee: The Standard Register Company, Dayton, Ohio

[21] Appl. No.: 09/276,980

[22] Filed: Mar. 26, 1999

[51] Int. Cl.[7] ..... B42D 15/00

[52] U.S. Cl. ..... 283/93; 283/72; 283/91; 283/902

[58] Field of Search ..... 283/93, 91, 72, 283/113, 70

[56] References Cited

U.S. PATENT DOCUMENTS

| | | | |
|---|---|---|---|
| 3,178,993 | 4/1965 | Ferris et al. | 88/1 |
| 3,227,474 | 1/1966 | Hoeflinger | 283/7 |
| 3,937,565 | 2/1976 | Alasia | 350/320 |
| 4,579,370 | 4/1986 | Corwin et al. | 283/72 |
| 4,668,597 | 5/1987 | Merchant | 430/22 |
| 5,034,982 | 7/1991 | Heninger et al. | 283/102 |
| 5,149,140 | 9/1992 | Mowry, Jr. et al. | 283/93 |
| 5,178,418 | 1/1993 | Merry et al. | 283/73 |
| 5,197,765 | 3/1993 | Moery, Jr. et al. | 283/93 |
| 5,291,243 | 3/1994 | Heckman et al. | 355/201 |
| 5,301,981 | 4/1994 | Nesis | 283/73 |
| 5,303,370 | 4/1994 | Brosh et al. | 380/51 |
| 5,340,159 | 8/1994 | Mowry, Jr. | 283/93 |
| 5,396,559 | 3/1995 | McGrew | 380/54 |
| 5,479,507 | 12/1995 | Anderson | 380/3 |
| 5,487,567 | 1/1996 | Volpe | 283/72 |
| 5,488,664 | 1/1996 | Shamir | 380/54 |
| 5,510,199 | 4/1996 | Martin | 428/690 |
| 5,577,774 | 11/1996 | Morikawa et al. | 283/93 |
| 5,591,527 | 1/1997 | Lu | 428/411.1 |
| 5,601,683 | 2/1997 | Martin | 156/277 |
| 5,611,575 | 3/1997 | Petrie | 283/67 |
| 5,708,717 | 1/1998 | Alasia | 380/51 |
| 5,735,547 | 4/1998 | Morelle et al. | 283/67 |
| 5,788,285 | 8/1998 | Wicker | 283/58 |
| 5,826,916 | 10/1998 | Philips | 283/91 |
| 5,860,679 | 1/1999 | Fukuda et al. | 283/70 |
| 5,863,075 | 1/1999 | Rich et al. | 283/94 |
| 5,904,375 | 5/1999 | Brugada | 283/85 |
| 5,951,055 | 9/1999 | Mowry, Jr. | 283/93 |
| 5,954,368 | 9/1999 | Mowry, Jr. | 283/93 |

*Primary Examiner*—Willmon Fridie, Jr.
*Assistant Examiner*—Alisa L. Thurston
*Attorney, Agent, or Firm*—Killworth, Gottman, Hagan & Schaeff LLP

[57] ABSTRACT

An optically decodable security document is provided comprising a security image area defined on a face of the document. The security image area is divided into a plurality of image element cells defining an array of image element cells across the security image area. The image element cells define first and second diagonal axes and a cell center positioned at the intersection of the first and second diagonal axes. A first type of printed tiling element is printed in selected ones of the image element cells to define a printed security image within the security image area. A second type of printed tiling element is printed in selected ones of the image element cells to define a printed complementary security image within the security image area. Individual ones of the first and second types of printed tiling elements comprise printed units positioned within the respective image element cells so as to define substantially equal printed tones defined by the printed units across the first and second types of printed tiling elements. The printed units within the first and second types of printed tiling elements are arranged such that (i) an imaging band extending across the security image and the complementary security image, parallel to one of the first and second diagonal axes, demarcates a security image band in the security image area and a complementary security image band in the complementary security image area, and (ii) the security image band and the complementary security image band are characterized by substantially different intra-band printed tones defined by the printed units within the security image band and the complementary security image band.

24 Claims, 10 Drawing Sheets

OPTICALLY DECODABLE SECURITY DOCUMENT

BACKGROUND OF THE INVENTION

The present invention relates to security documents including a security image area composed of a printed security image and a printed complementary security image. The security image area is arranged to provide an indication of document authenticity.

Conventional security documents comprise a security image area including security image elements and complementary security image elements designed such that an attempted duplication or reproduction results in the formation of a readily apparent warning image on the face of the duplicate document. The security image elements and the complementary security image elements are arranged such that the presence of the security image and the security image elements is not readily apparent on the original. Examples of security documents of this type are illustrated in U.S. Pat. Nos. 4,579,370, 5,149,140, 5,197,765, 5,340,159, the disclosures of which are incorporated herein by reference.

The above-described conventional security documents can be said to provide a negative indication of validity because the alteration created by the attempted duplication results in the formation of a warning image on the face of the attempted duplicate. There is, however, no positive indication on the original document that it is valid. Rather, the security image is merely arranged to provide a warning message on the attempted duplicate. Accordingly, there is a need for a security document production wherein a positive indication of validity may be gleaned from the original document, regardless of whether an attempt has been made to duplicate the document.

BRIEF SUMMARY OF THE INVENTION

This need is met by the present invention wherein an optically decodable security document is provided. In accordance with one embodiment of the present invention, a security document is provided comprising a security image area defined on a face of the document. The security image area is divided into a plurality of image element cells defining an array of image element cells across the security image area. The image element cells define first and second diagonal axes and a cell center positioned at the intersection of the first and second diagonal axes. A first type of printed tiling element is printed in selected ones of the image element cells to define a printed security image within the security image area. A second type of printed tiling element is printed in selected ones of the image element cells to define a printed complementary security image within the security image area. Individual ones of the first and second types of printed tiling elements comprise printed units positioned within the respective image element cells and may be arranged to define substantially equal printed tones across the first and second types of printed tiling elements. The printed units within the first and second types of printed tiling elements are arranged such that (i) an imaging band extending across the security image and the complementary security image, parallel to one of the first and second diagonal axes, demarcates a security image band in the security image area and a complementary security image band in the complementary security image area, and (ii) the security image band and the complementary security image band are characterized by substantially different intra-band printed tones defined by the printed units within the security image band and the complementary security image band.

The first and second types of printed tiling elements may be rotated relative to one another in the plane of the document face such that a first diagonal axis of the first type of printed tiling element is aligned, along a linear projection, with a second diagonal axis of the second type of printed tiling element.

The imaging band may be characterized by a width selected to circumscribe only those printed units positioned on a single linear projection parallel to one of the first and second diagonal axes. The printed tiling elements may be arranged such that a plurality of imaging bands demarcate respective security image bands and complementary security image bands in the security image area, and such that the respective security image bands and complementary security image bands demarcated by individual ones of the plurality of imaging bands are characterized by substantially different intra-band printed tones.

The array of image element cells may comprise a uniform array of adjacent rows and columns across the security image area. The first type of printed tiling element and the second type of printed tiling element may comprise printed units positioned within the uniform array of adjacent rows and columns. The first and second types of printed tiling elements may define substantially identical printed unit arrangements of substantially equal printed tones. The first and second types of printed tiling elements may define substantially identical printed unit arrangements that are rotated relative to one another in the plane of the document face. The first and second types of printed tiling elements are preferably rotated 90° relative to one another in the plane of the document face.

The image element cells define first and second diagonal axes and a cell center positioned at the intersection of the first and second diagonal axes, an individual ones of the printed tiling elements may comprise: (i) at least two on-axis printed units substantially aligned with the first diagonal axis, wherein the on-axis printed units are positioned on opposite sides of the cell center; and (ii) at least two pairs of off-axis printed units substantially offset from the second diagonal axis, wherein the pairs of off-axis printed units are positioned on opposite sides of the cell center. The first and second types of printed tiling elements are preferably rotated relative to one another in the plane of the document face such that a first diagonal axis of the first type of printed tiling element is aligned, along a linear projection, with a second diagonal axis of the second type of printed tiling element. Individual ones of the printed tiling elements may define a skewed hexagon, wherein the skewed hexagon is characterized by a first diagonal axis dimension that is different than a second diagonal axis dimension. Individual ones of the printed tiling elements may further comprise a central printed unit positioned proximate the cell center, partial printed units positioned in respective corners of individual tiling elements, two on-axis printed units on each side of the cell center, or two pairs of off-axis printed units on each side of the cell center.

The printed units may be positioned such that image element cells including the first and second types of printed tiling elements define substantially identical repeating printed elements. Individual ones of the repeating printed elements may comprise apportioned repeating printed elements, wherein the apportioned repeating printed elements are defined by a combination of printed units from neighboring image element cells.

Each of the image element cells may define a series a primary diagonal axes and a series of corresponding rotated diagonal axes, wherein the rotated diagonal axes are defined by a rotation of the primary diagonal axes about a center of the image element cell. In addition, individual ones of the first and second types of printed tiling elements may comprise printed units positioned within the respective image element cells such that a number of printed units positioned along a selected primary diagonal axis differs from a number of printed units positioned along a corresponding rotated diagonal axis. Further, the first and second types of printed tiling elements may be rotated relative to one another in the plane of the document face such that the primary diagonal axes of a first type of printed tiling element are aligned, along respective linear projections, with the rotated diagonal axes of a second type of printed tiling element.

The security image and the complementary security image may be arranged to define an image conveying a positive indication of validity. The image conveying a positive indication of validity may comprise a term, e.g., VALID, ORIGINAL, AUTHORIZED, etc., a graphical image, or an entity identifier.

In accordance with another embodiment of the present invention, a security document is provided comprising a security image area defined on a face of the document. The security image area is divided into a plurality of image element cells defining an array of image element cells across the security image area. The image element cells define first and second diagonal axes and a cell center positioned at the intersection of the first and second diagonal axes. A first type of printed tiling element is printed in selected ones of the image element cells to define a printed security image within the security image area. A second type of printed tiling element is printed in selected ones of the image element cells to define a printed complementary security image within the security image area. Individual ones of the first and second types of printed tiling elements comprise printed units positioned within the respective image element cells and may be arranged to define substantially equal printed tones across the first and second types of printed tiling elements. The image element cells define first and second diagonal axes and a cell center positioned at the intersection of the first and second diagonal axes. Individual ones of the printed tiling elements comprise (i) at least two on-axis printed units substantially aligned with the first diagonal axis, wherein the on-axis printed units are positioned on opposite sides of the cell center, and (ii) at least two pairs of off-axis printed units substantially offset from the second diagonal axis, wherein the pairs of off-axis printed units are positioned on opposite sides of the cell center. The first and second types of printed tiling elements are rotated relative to one another in the plane of the document face such that a first diagonal axis of the first type of printed tiling element is aligned, along a linear projection, with a second diagonal axis of the second type of printed tiling element.

In accordance with yet another embodiment of the present invention, a security document is provided comprising a security image area defined on a face of the document. The security image area is divided into a plurality of image element cells defining an array of image element cells across the security image area. A first type of printed tiling element is printed in selected ones of the image element cells to define a printed security image within the security image area. A second type of printed tiling element is printed in selected ones of the image element cells to define a printed complementary security image within the security image area. Each of the image element cells define a series a primary diagonal axes and a series of corresponding rotated diagonal axes, wherein the rotated diagonal axes are defined by a rotation of the primary diagonal axes about a center of the image element cell. Individual ones of the first and second types of printed tiling elements comprise printed units positioned within the respective image element cells such that a number of printed units positioned along a selected primary diagonal axis differs from a number of printed units positioned along a corresponding rotated diagonal axis. The first and second types of printed tiling elements are rotated relative to one another in the plane of the document face such that the primary diagonal axes of a first type of printed tiling element are aligned, along respective linear projections, with the rotated diagonal axes of a second type of printed tiling element.

In accordance with yet another embodiment of the present invention, a system for viewing a security image on a security document is provided comprising a document viewer and a security document comprising a security image area defined on a face of the document. The security image area is divided into a plurality of image element cells defining an array of image element cells across the security image area. The array of image element cells is characterized by an element array frequency $f_1$. The image element cells define first and second diagonal axes and a cell center positioned at the intersection of the first and second diagonal axes. A first type of printed tiling element is printed in selected ones of the image element cells to define a printed security image within the security image area. A second type of printed tiling element is printed in selected ones of the image element cells to define a printed complementary security image within the security image area. Individual ones of the first and second types of printed tiling elements comprise printed units positioned within the respective image element cells and may be arranged to define substantially equal printed tones across the first and second types of printed tiling elements. The printed units within the first and second types of printed tiling elements are arranged such that (i) an imaging band extending across the security image and the complementary security image, parallel to one of the first and second diagonal axes, demarcates a security image band in the security image area and a complementary security image band in the complementary security image area, and (ii) the security image band and the complementary security image band are characterized by substantially different intra-band printed tones defined by the printed units within the security image band and the complementary security image band. The document viewer comprises a plurality of lens elements arranged in a lens element array, wherein the lens element array is characterized by a lens element array frequency $f_0$, and wherein $f_0$ and $f_1$ satisfy at least one of the following equations $$f_1 \approx a f_0$$

$$f_0 \approx b f_1$$

where a and b are positive whole numbers.

In accordance with yet another embodiment of the present invention, a security document processing system comprises a document issuing station and at least one document receiving station. The document receiving station includes a security document viewer arranged to read a security image printed on a security document designed in accordance with the present invention.

Accordingly, it is an object of the present invention to provide an optically decodable security document that presents a positive indication of validity on the original document, regardless of whether an attempt has been made to duplicate the document. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
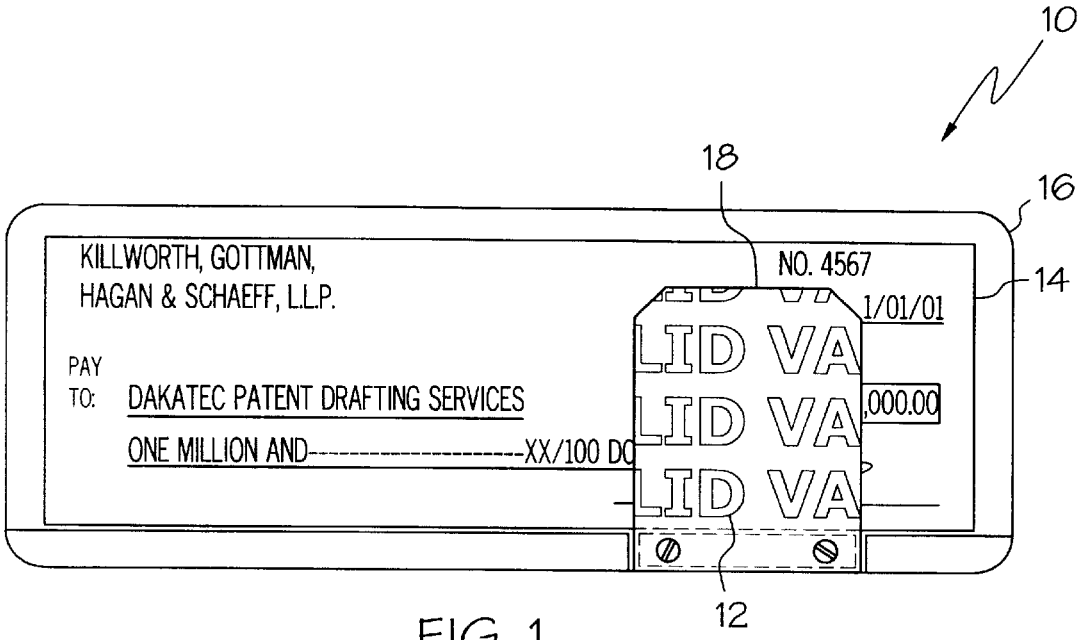
FIG. 1 is an illustration of a document viewer and an optically decodable security document according to the present invention.
Figure 2:
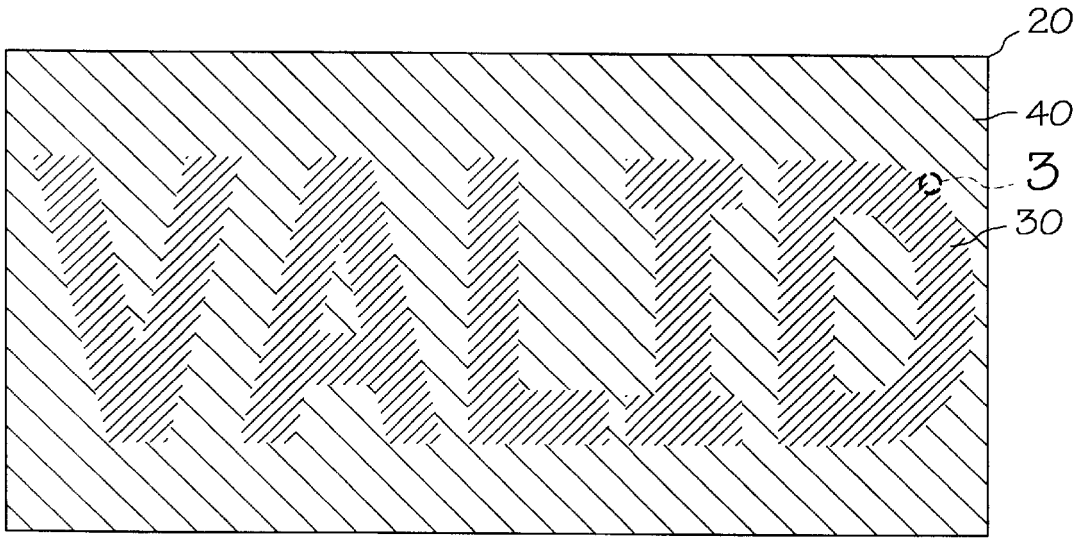
FIG. 2 is a schematic illustration of a security image area according to the present invention.

Referring initially to FIG. 1, a system 10 for viewing a hidden image 12 on a security document 14 according to the present invention is illustrated schematically. The system 10 includes a document viewer 16 arranged to accommodate the security document 14 in a viewing plane of an optical lens 18. As will be described in further detail below with reference to FIGS. 2–7, the hidden image 12 and the optical lens 18 are arranged such that the hidden image 12 is readily apparent on the face of the security document 14 only when viewed through the optical lens 18.

Referring now to FIGS. 1 and 2–7, the security document 14 comprises a security image area 20 defined on a face of the document 14. The security image area 20 is divided into a plurality of image element cells 22 defining an array of image element cells across the security image area 20. Although only two image element cells 22 are demarcated in FIG. 3, it will be appreciated by those practicing the present invention that the array of image element cells 22 comprises a uniform array of adjacent rows and columns across the security image area 20.

A first type of printed tiling element 32 is printed in selected ones of the image element cells 22 to define a printed security image 30 within the security image area 20. A second type of printed tiling element 42 is printed in selected ones of the image element cells 22 to define a printed complementary security image 40 within the security image area (see FIGS. 2 and 3). Individual ones of the first and second types of printed tiling elements comprise printed units 24 positioned within the respective image element cells 22 so as to define substantially equal printed tones defined by the printed units 24 across the first and second types of printed tiling elements 32, 42. In this manner, the security image 30 and the complementary security image 40 are not readily distinguishable by the naked eye. As is clearly illustrated in FIGS. 3–7, the first and second types of printed tiling elements 32, 42 define substantially identical printed unit arrangements, with the exception that the arrangements are rotated 90° relative to one another in the plane of the document face. From an alternative frame of reference, it may also be said that the respective arrangements are reflected 90° relative to one another around a vertical axis in the plane of the document face.

Figure 3:
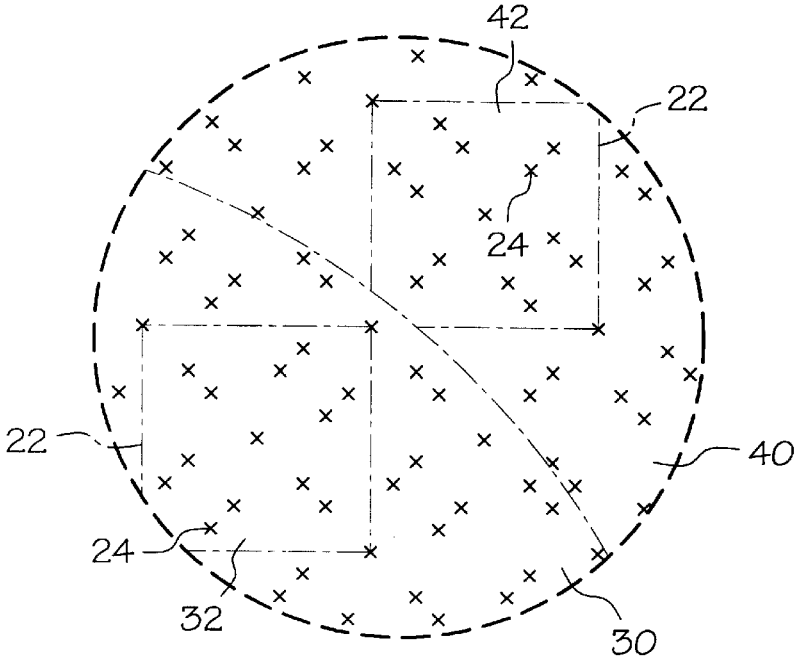
FIG. 3 is a schematic illustration of a portion of the security image area illustrated in FIG. 2.

The printed units are merely illustrated schematically in the drawings and it is contemplated by the present invention that the printed units may be printed dots, squares, lines, circles, stars, or characters of a variety of sizes, or any other graphical shapes suitable for the construction of a security image. For example, in one embodiment of the present invention, the printed units 24 are arranged as illustrated in FIG. 3. Each printed unit is comprised of a plurality of printed pixels. The printed pixels are arranged to form the selected printed unit, which may be, for example, a printed dot. Each image element cell 22 includes the predetermined arrangement of printed dots (see, for example, the arrangement of FIG. 3). Preferably, the printed pixels are arranged in an array and the array is characterized by a frequency of 5080 pixels per inch. Where the printed units are selected to form a dot, the size of the dot may be defined by the limits of a square matrix of 6–12 pixels in width. The size of the image element cell may be defined by the limits of a square matrix of about 112 pixels in width.

Figure 4:
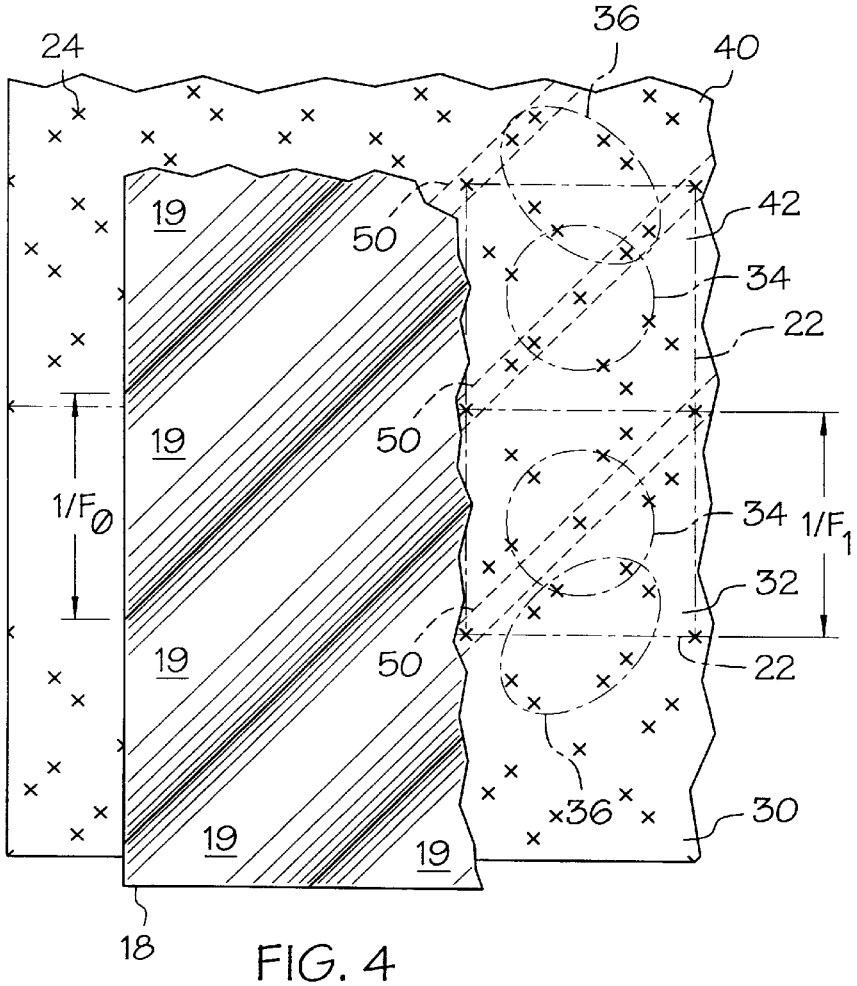
FIG. 4 is a schematic illustration, partially broken away, of a security document according to the present invention positioned in a viewing plane of a lens element array portion of the document viewer illustrated in FIG. 1.
Figure 8:
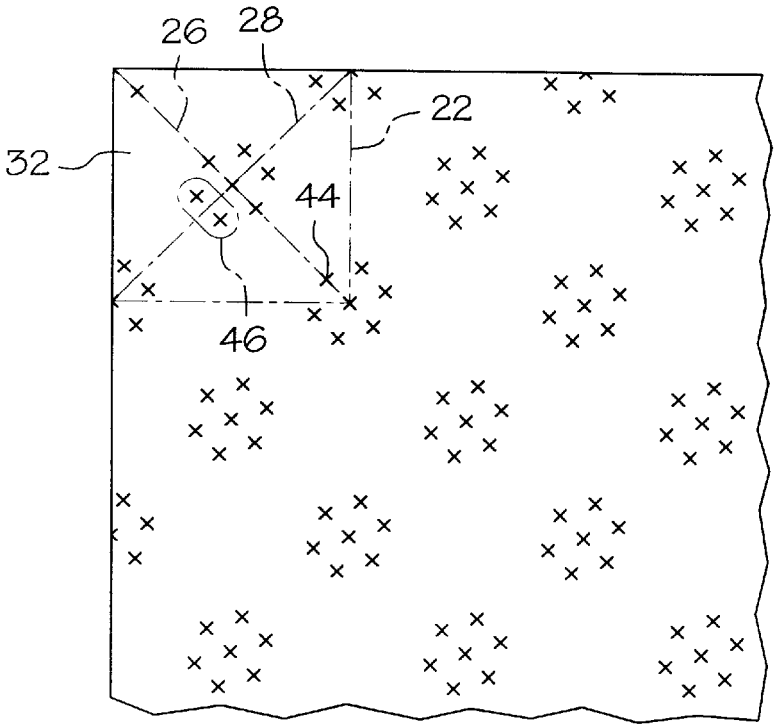
FIGS. 8–16 are schematic illustrations of alternative tiling elements according to the present invention.
Figure 9:
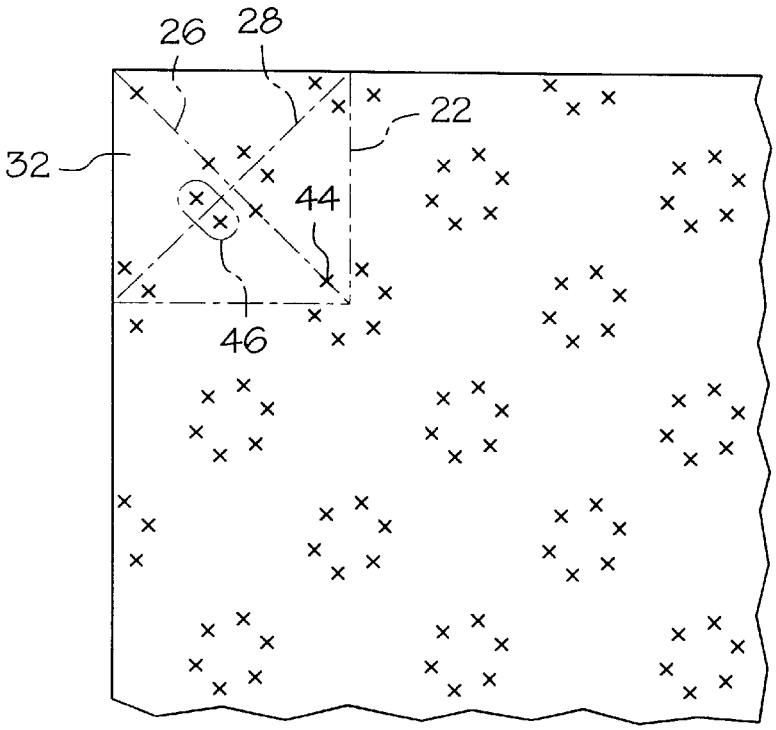
Figure 10:
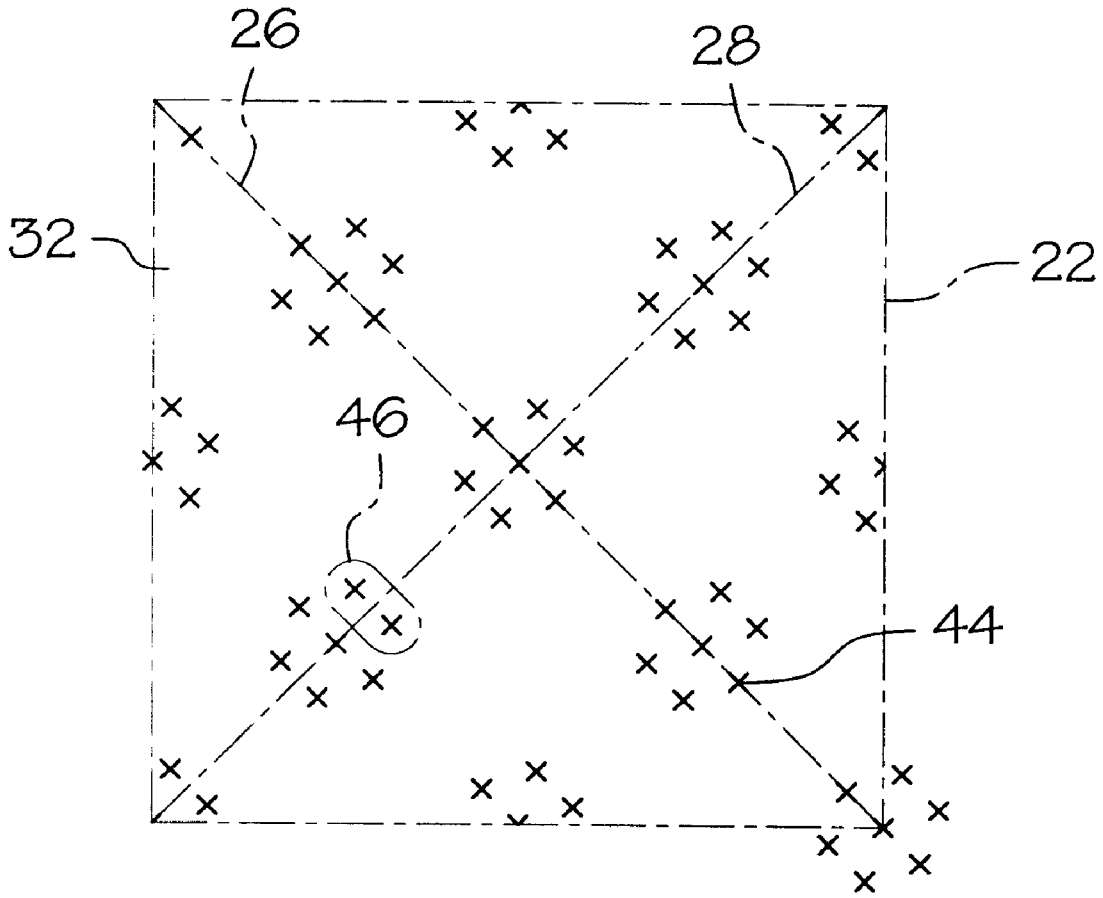
Figure 11:
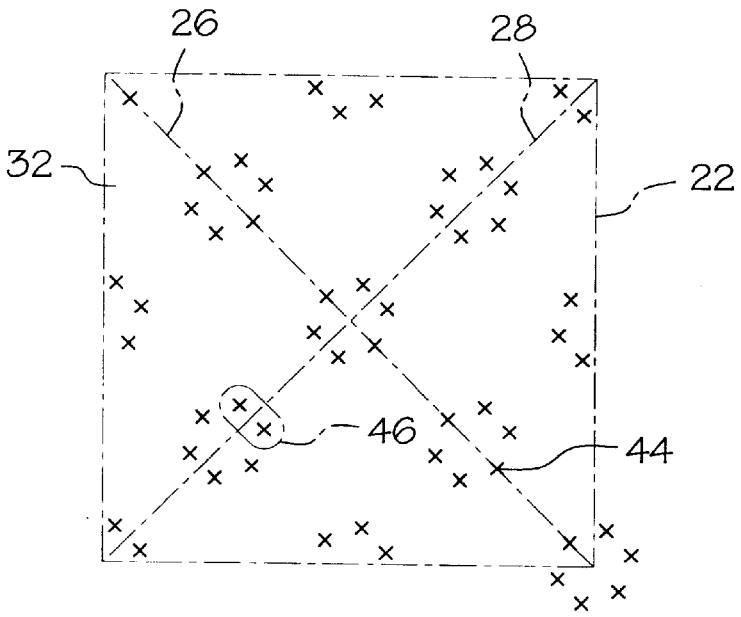
Figure 12:
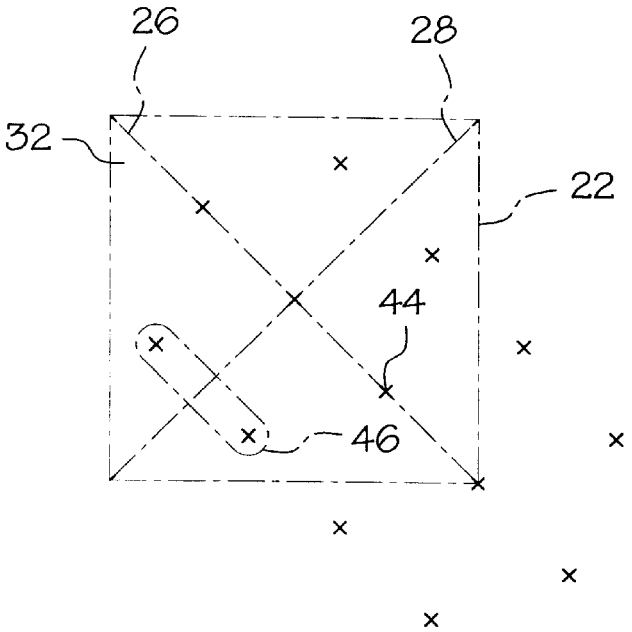
Figure 13:
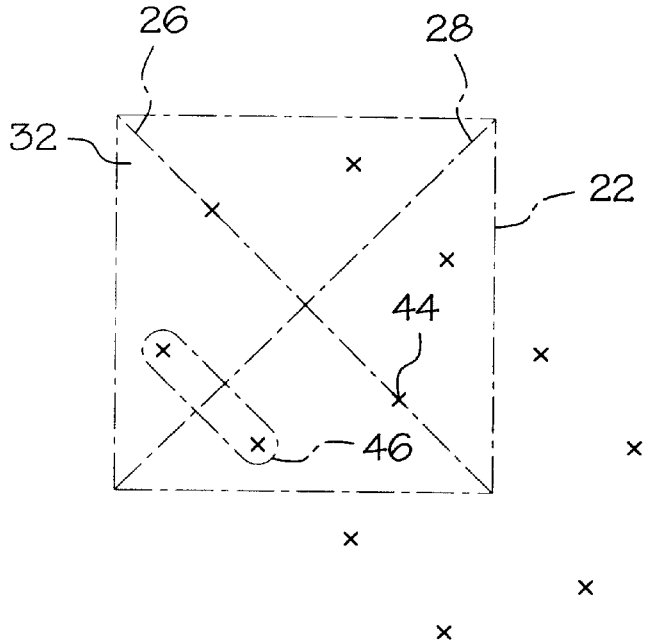
Figure 14:
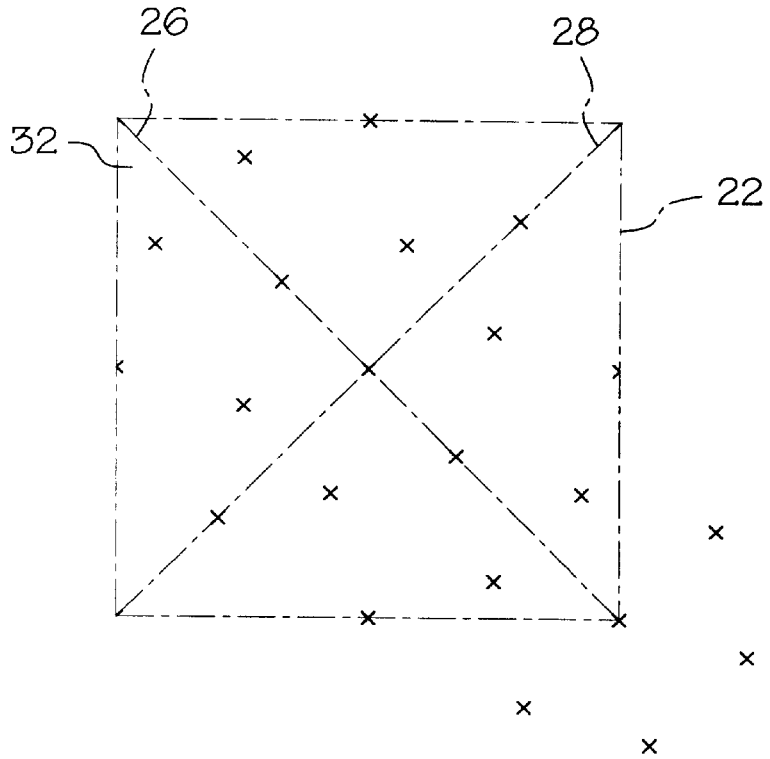
Figure 15:
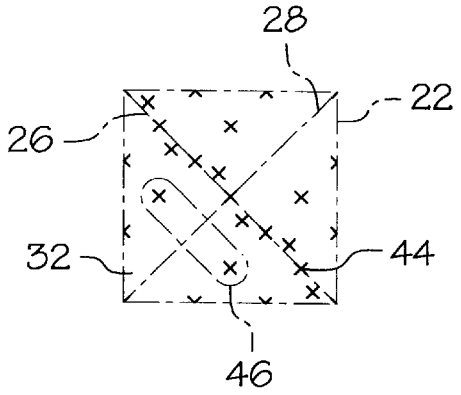
Figure 16:
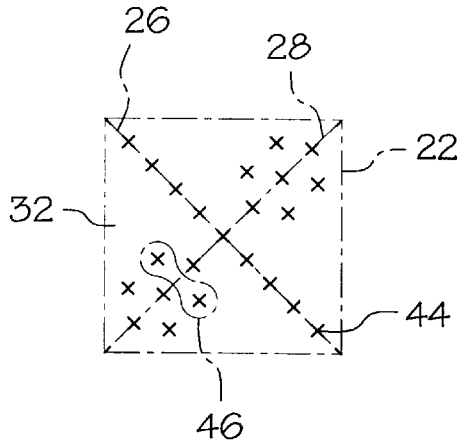

To further enhance the effective "blending" of the security image 30 and the complementary security image 40, the printed units 24 of the printed tiling elements 32, 42 are positioned such that image element cells including the first and second types of printed tiling elements 32, 42 define substantially identical repeating printed elements 34 and substantially identical apportioned repeating printed elements 36 (see FIG. 4). The apportioned repeating printed elements 36 are defined by a combination of printed units from neighboring image element cells 22. As is clearly illustrated in FIGS. 8 and 9, the apportioned repeating printed elements may be identical to the repeating printed elements in the interior of the tiling element.

FIG. 4 includes a detailed illustration of a representative portion of the optical lens 18. The optical lens 18 comprises a lenticular lens sheet including a plurality of linear lens elements 19 arranged in a lens element array. Each lens element 19 is arranged to create a magnified image of any printed unit 24 positioned on the security document 14 within an imaging band 50 corresponding to the selected lens element 19. Printed elements 24 outside of the imaging band 50 are not imaged. In this manner, a specific selection of printed units 24 on the security document 14 may be viewed through the optical lens 18. The selection of the printed units viewed is defined by the design of the optical lens 18. In the illustrated embodiment, printed units along a series of spaced parallel lines are imaged through the optical lens 18 because it includes a plurality of linear lens elements 19. However, it is contemplated by the present invention that the lens element arrangement of the present invention is not limited to linear lens elements.

Figure 5:
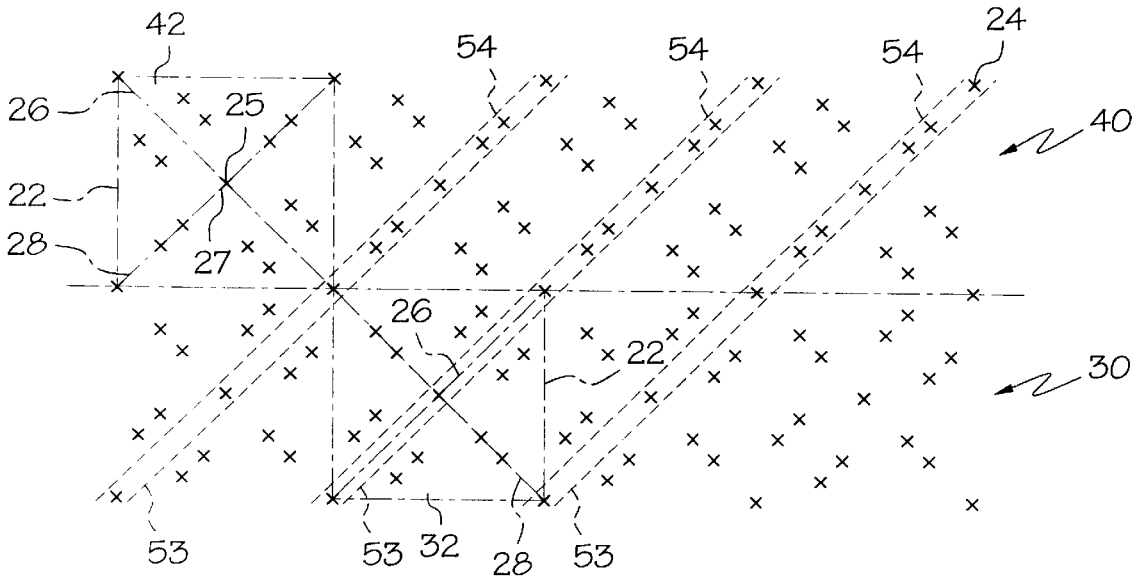
FIG. 5 is a schematic illustrations of a series of imaging bands extending across a portion of a security image area according to the present invention.

Referring now to FIG. 5, the image element cells 22 define first and second diagonal axes 26, 28 and a cell center 25 positioned at the intersection of the first and second diagonal axes 26, 28. As is illustrated in FIG. 4, the imaging band 50 is characterized by a width selected to circumscribe only those printed units 24 positioned on a single linear projection parallel to one of the first and second diagonal axes 26, 28.

Figure 6:
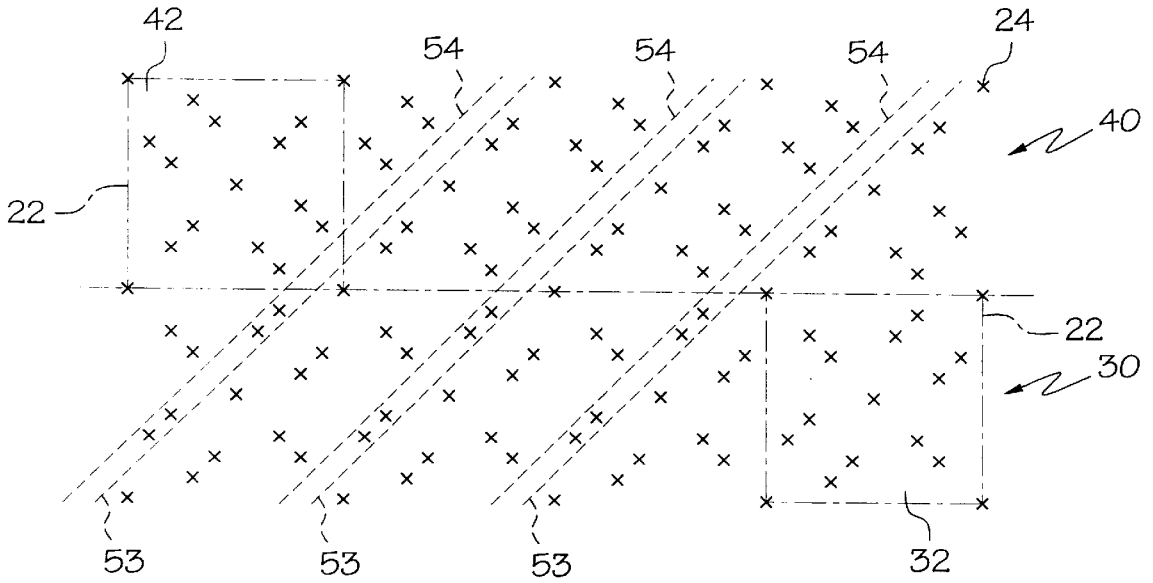
FIGS. 6 and 7 are further illustrations of the imaging bands illustrated in FIG. 5, with the exception that the bands extend over successively advanced portions of the security image area.
Figure 7:
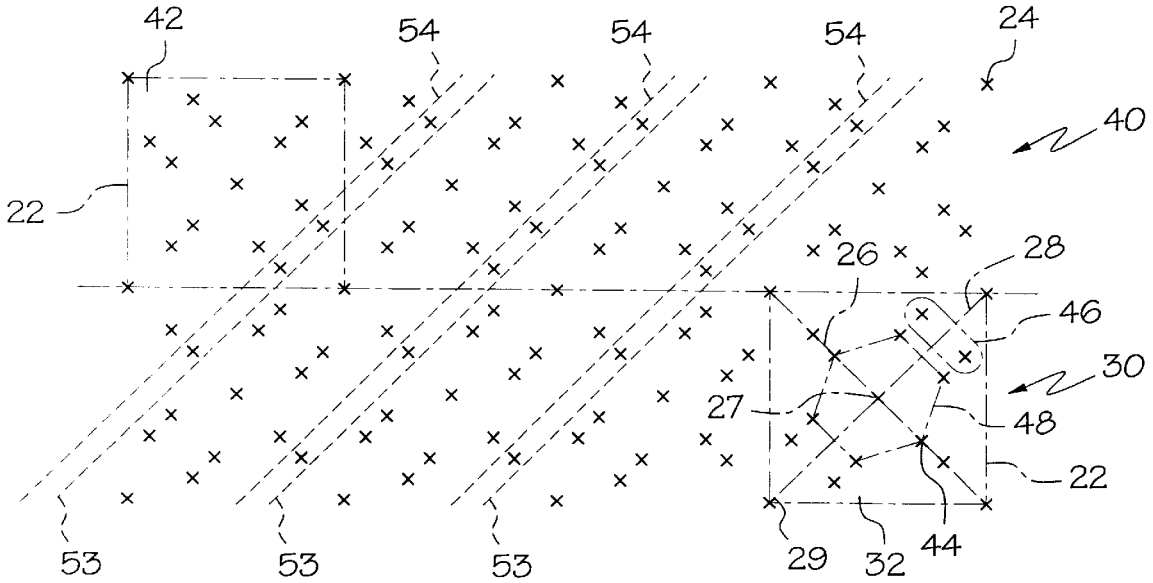

The first and second types of printed tiling elements are rotated relative to one another in the plane of the document face such that the first diagonal axis 26 of the first type of printed tiling element 32 is aligned, along a linear projection, with a second diagonal axis 28 of the second type of printed tiling element 42. The printed units 24 within the first and second types of printed tiling elements 32, 42 are arranged such that (i) a selected imaging band 50 extending across the security image 30 and the complementary security image 40, parallel to one of the diagonal axes 26, 28, demarcates a security image band 53 in the security image area 30 and a complementary security image band 54 in the complementary security image area 40, and (ii) the security image band 53 and the complementary security image band 54 are characterized by substantially different intra-band printed tones defined by the printed units 24 within the security image band 53 and the complementary security image band 54. Stated differently, the security image band 53 and the complementary security image band 54 include different numbers of printed units 24 therein. This contrasting tone relationship preferably holds true for all possible imaging band positions. In FIG. 5, for example, the complementary security image band 54 includes approximately four times the number of printed units 24 as the security image band 53. In FIG. 6, the complementary security image band 54 does not include any printed units 24 while the security image band 53 includes a plurality of printed units 24. In FIG. 7, the complementary security image band 54 includes approximately two times the number of printed units 24 as the security image band 53. It is contemplated by the present invention that, as an alternative to varying the frequency of the printed units 24 across the two bands 53, 54, the size of the printed units 24 within, for example, the security image band 53, may be selected to be different than the size of the printed units in, for example, the complementary security image band 54.

Accordingly, if the optical lens 18 is positioned such that the lens elements 19 are aligned with one of the diagonal axes 26, 28, the distinctive tones of the respective security image bands 53, 54 across a plurality of imaging bands 50 will result in the formation of a visible image of the document face that includes the respective distinctive or contrasting tones corresponding to the security image 30 and the complementary security image 40. The contrasting tones will render the hidden term or image 12 formed by the security image 30 and the complementary security image 40 readily apparent. As is illustrated in FIG. 1, the security image is preferably arranged to define an image conveying a positive indication of document validity. Specifically, the image may comprise a word ("VALID," "ORIGINAL," or "AUTHORIZED"), a graphical image, or an entity identifier (company name, logo, etc).

Referring again to FIG. 4, the lens element array is characterized by a lens element array frequency $f_0$. The array of image element cells 22 is characterized by an element array frequency $f_1$. In the illustrated embodiment $f_0$ and $f_1$ are selected such that they are substantially equal. However, it is contemplated by the present invention that $f_0$ and $f_1$ need only satisfy at least one of the following equations to render the security image visible:

$$f_1 \cong af_0$$

$$f_0 \cong bf_1$$

where a and b are positive whole numbers.

Turning now to a more specific description of the variety of printed tiling elements 32 illustrated in FIGS. 7–16, it is noted that the image element cells 22 define first and second diagonal axes 26, 28 and a cell center positioned at the intersection of the first and second diagonal axes 26, 28. The printed tiling elements 32 illustrated in FIGS. 7–16 comprise at least two on-axis printed units 44 substantially aligned with the first diagonal axis 26 and at least two pairs of off-axis printed units 46 substantially offset from the second diagonal axis 28. The on-axis printed units 44 and the pairs of off-axis printed units 46 are positioned on opposite sides of the cell center.

Individual ones of the printed tiling elements 32 illustrated in FIG. 7–16 define respective skewed hexagons 48 (see FIG. 7), i.e., a hexagon characterized by a first diagonal axis dimension that is different than a second diagonal axis dimension. Individual ones of the printed tiling elements 32, 42 further comprise a central printed unit 27 and partial printed units 29 positioned in respective corners of the tiling elements 32 (see FIG. 7). As is clearly illustrated in FIG. 7, the partial printed units 29 are defined and positioned to complement partial printed units 29 in adjacent tiling elements so as to form a collective printed unit that is substantially identical to the remaining printed units 27, 44, 46 in the interior of the tiling element.

Figure 18:
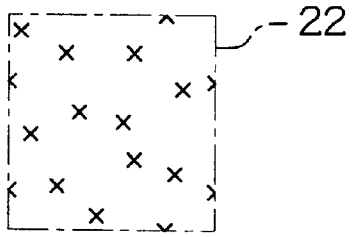
FIGS. 18–20 are schematic illustrations of further alternative image element cells according to the present invention.
Figure 19:
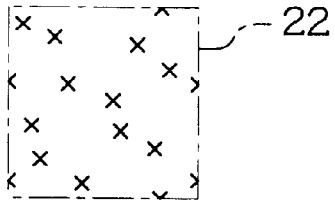
Figure 20:
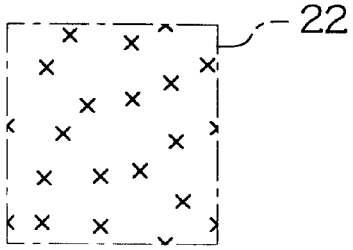

Further examples of image element cells 22 according to the present invention are illustrated in FIGS. 18–20. The illustrated tiling elements are particularly well suited for construction of a security image using the image elements as shown and a complementary security image by reflecting the image element cells 22 90° about a vertical axis in the plane of the security document on which the image is to be produced. The arrangement illustrated in FIGS. 18–20 also represents tiling elements that are progressively more well suited for embodiments of the present invention where higher lens element array frequencies $f_0$ are employed. Specifically, the arrangement of FIG. 18 is designed to be well suited for a lens element array frequency of about 64 lens elements per inch (Ipi), the arrangement of FIG. 19 is designed to be well suited for a lens element array frequency of about 142 Ipi, and the arrangement of FIG. 20 is designed to be well suited for a lens element array frequency of about 142 Ipi.

Figure 17:
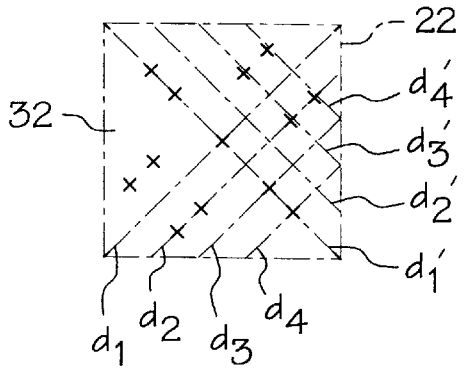
FIG. 17 is an illustration of a principle tiling element according to the present invention.

Referring now to FIG. 17, an alternative illustration of a principle tiling element 32 according to the present invention is presented. The image element cell 22 defines a series a primary diagonal axes $d_1$, $d_2$, $d_3$, $d_4$ and a series of corresponding rotated diagonal axes $d_1'$, $d_2'$, $d_3'$, $d_4'$. The rotated diagonal axes $d_1'$, $d_2'$, $d_3'$, $d_4'$ are defined by a 90° rotation of the primary diagonal axes $d_1$, $d_2$, $d_3$, $d_4$ about the center of the image element cell 22. Referring now to the arrangement of FIG. 3, in light of the illustration of FIG. 17, it may be said that individual ones of the first and second types of printed tiling elements 32, 42 comprise printed units 24 positioned within the respective image element cells 22 such that a number of printed units 24 positioned along a selected primary diagonal axis, e.g., $d_1$, differs from a number of printed units 24 positioned along a corresponding rotated diagonal axis, e.g., $d_1'$. The first and second types of printed tiling elements 32, 42 are rotated relative to one another in the plane of the document face such that the primary diagonal axes $d_1$, $d_2$, $d_3$, $d_4$ of the first type of printed tiling element 32 are aligned, along respective linear projections, with the rotated diagonal axes $d_1'$, $d_2'$, $d_3'$, $d_4'$ of the second type of printed tiling element 42. The alignment of the respective axes is illustrated clearly in FIGS. 5–7, where the axes are aligned along the linear imaging bands 50.

It is contemplated by the present invention that security documents incorporating a security image according to the present invention, may be utilized in a comprehensive security document processing system. Typically, the document processing system would comprise a document issuing station and at least one document receiving station, wherein the document receiving station would include a security document reader or viewer arranged to read data or a security image printed on the security document.

Having described the invention in detail and by reference to preferred embodiments thereof, it will be apparent that modifications and variations are possible without departing from the scope of the invention defined in the appended claims.

What is claimed is:

1. A security document comprising a security image area defined on a face of said document, wherein:

said security image area is divided into a plurality of image element cells defining an array of image element cells across said security image area;

a first type of printed tiling element is printed in selected ones of said image element cells to define a printed security image within said security image area;

a second type of printed tiling element is printed in selected ones of said image element cells to define a printed complementary security image within said security image area;

said image element cells define first and second diagonal axes and a cell center positioned at the intersection of said first and second diagonal axes;

individual ones of said first and second printed tiling elements comprise:

at least two on-axis printed units substantially aligned with said first diagonal axis, wherein said on-axis printed units are positioned on opposite sides of said cell center; and at least two pairs of off-axis printed units substantially offset from said second diagonal axis, wherein said pairs of off-axis printed units are positioned on opposite sides of said cell center.

2. A security document as claimed in claim 1 wherein said first and second types of printed tiling elements define substantially identical printed unit arrangements of substantially equal printed tones.

3. A security document as claimed in claim 1 wherein said first and second types of printed tiling elements are rotated relative to one another in the plane of the document face such that a first diagonal axis of said first type of printed tiling element is aligned, along a linear projection, with a second diagonal axis of said second type of printed tiling element.

4. A security document as claimed in claim 1 wherein said printed units define a hexagon.

5. A security document as claimed in claim 1 wherein said security image area is divided such that said image element cells define first and second diagonal axes and a cell center positioned at the intersection of said first and second diagonal axes, and wherein individual ones of said printed tiling elements define a skewed hexagon, wherein said skewed hexagon is characterized by a first diagonal axis dimension that is different than a second diagonal axis dimension.

6. A security document as claimed in claim 1 wherein a boundary of respective image element cells defines a square.

7. A security document as claimed in claim 1 wherein individual ones of said printed tiling elements further comprise a central printed unit positioned proximate said cell center.

8. A security document as claimed in claim 1 wherein individual ones of said printed tiling elements further comprise two on-axis printed units on each side of said cell center.

9. A security document as claimed in claim 1 wherein individual ones of said printed tiling elements further comprise two pairs of off-axis printed units on each side of said cell center.

10. A security document as claimed in claim 1 wherein individual ones of said printed tiling elements further comprise:

a central printed unit positioned proximate said cell center;

two on-axis printed units on each side of said cell center;

two pairs of off-axis printed units on each side of said cell center;

partial printed units positioned in respective corners of individual tiling elements, wherein said partial printed units are defined and positioned to complement partial printed units in adjacent tiling elements so as to form a collective printed unit that is substantially identical to at least one of said central printed unit, said on-axis printed units, and said off-axis printed units.

11. A security document as claimed in claim 1 wherein each of said image element cells define a series of primary diagonal axes and a series of corresponding rotated diagonal axes, wherein said rotated diagonal axes are defined by a rotation of said primary diagonal axes about a center of said image element cell;

individual ones of said first and second types of printed tiling elements comprise printed units positioned within said respective image element cells such that a number of printed units positioned along a selected primary diagonal axis differs from a number of printed units positioned along a corresponding rotated diagonal axis; and said first and second types of printed tiling elements are rotated relative to one another in the plane of the document face such that said primary diagonal axes of a first type of printed tiling element are aligned, along respective linear projections, with said rotated diagonal axes of a second type of printed tiling element.

12. A security document as claimed in claim 1 wherein each of said image element cells define a series a primary diagonal axes and a series of corresponding reflected diagonal axes, wherein said reflected diagonal axes are defined by a reflection of said primary diagonal axes about a vertical axis of said image element cell in the plane of the document face;

individual ones of said first and second types of printed tiling elements comprise printed units positioned within said respective image element cells such that a number of printed units positioned along a selected primary diagonal axis differs from a number of printed units positioned along a corresponding reflected diagonal axis; and said first and second types of printed tiling elements are reflected relative to one another in the plane of the document face such that said primary diagonal axes of a first type of printed tiling element are aligned, along respective linear projections, with said reflected diagonal axes of a second type of printed tiling element.

13. A security document as claimed in claim 1 wherein said security image and said complementary security image are arranged to define an image conveying a positive indication of validity.

14. A security document as claimed in claim 13 wherein said image conveying a positive indication of validity comprises a graphical image.

15. A security document as claimed in claim 13 wherein said image conveying a positive indication of validity comprises an entity identifier.

16. A security document as claimed in claim 1 wherein said printed units are arranged to define substantially equal printed tones across said first and second types of printed tiling elements.

17. A security document comprising a security image area defined on a face of said document, wherein:

said security image area is divided into a plurality of image element cells defining an array of image element cells across said security image area;

a second type of printed tiling element is printed in selected ones of said image element cells to define a printed complementary security image within said security image area;

individual ones of said first and second printed tiling elements comprise printed units positioned within respective ones of said first and second printed tiling elements;

individual ones of said first and second printed tiling elements further comprise partial printed units positioned in respective corners of individual tiling elements; and said partial printed units are defined and positioned to complement partial printed units in adjacent tiling elements so as to form a collective printed unit that is substantially identical to printed units in respective interiors of said first and second printed tiling elements.

18. A security document comprising a security image area defined on a face of said document, wherein:

said security image area is divided into a plurality of image element cells defining an array of image element cells across said security image area;

a first type of printed tiling element is printed in selected ones of said image element cells to define a printed security image within said security image area;

a second type of printed tiling element is printed in selected ones of said image element cells to define a printed complementary security image within said security image area;

individual ones of said first and second printed tiling elements comprise printed units positioned such that an image element cell including said first type of printed tiling element defines a repeating printed element that is substantially identical to a repeating printed element defined by printed units of said second type of printed tiling element.

19. A security document comprising a security image area defined on a face of said document, wherein:

said security image area is divided into a plurality of image element cells defining an array of image element cells across said security image area;

a first type of printed tiling element is printed in selected ones of said image element cells to define a printed security image within said security image area;

a second type of printed tiling element is printed in selected ones of said image element cells to define a printed complementary security image within said security image area;

individual ones of said first and second printed tiling elements comprise printed units positioned such that an image element cell including said first type of printed tiling element defines a repeating printed element that is substantially identical to a repeating printed element defined by printed units of said second type of printed tiling element;

said printed units are positioned such that image element cells including said first and second types of printed tiling elements further define apportioned repeating printed elements defined by a combination of printed units from neighboring image element cells; and said apportioned repeating printed elements are substantially identical to said repeating printed elements.

20. A security document comprising a security image area defined on a face of said document, wherein:

said security image area is divided into a plurality of image element cells defining an array of image element cells across said security image area;

said image element cells define first and second diagonal axes and a cell center positioned at the intersection of said first and second diagonal axes;

first type of printed tiling element is printed in selected ones of said image element cells to define a printed security image within said security image area;

a second type of printed tiling element is printed in selected ones of said image element cells to define a printed complementary security image within said security image area;

individual ones of said first and second types of printed tiling elements comprise printed units positioned within said respective image element cells;

said image element cells define first and second diagonal axes and a cell center positioned at the intersection of said first and second diagonal axes;

individual ones of said first and second printed tiling elements comprise at least two on-axis printed units substantially aligned with said first diagonal axis, wherein said on-axis printed units are positioned on opposite sides of said cell center, and at least two pairs of off-axis printed units substantially offset from said second diagonal axis, wherein said pairs of off-axis printed units are positioned on opposite sides of said cell center; and said first and second types of printed tiling elements are rotated relative to one another in the plane of the document face such that a first diagonal axis of said first type of printed tiling element is aligned, along a linear projection, with a second diagonal axis of said second type of printed tiling element.

21. A security document as claimed in claim 20 wherein said printed units are arranged to define substantially equal printed tones across said first and second types of printed tiling elements.

22. A security document as claimed in claim 20 wherein a boundary of respective image element cells defines a square.

23. A security document as claimed in claim 20 wherein said printed units within said first and second types of printed tiling elements are arranged such that:

an imaging band extending across said security image and said complementary security image, parallel to one of said first and second diagonal axes, demarcates a security image band in said security image area and a complementary security image band in said complementary security image area; and said security image band and said complementary security image band are characterized by substantially different intra-band printed tones defined by said printed units within said security image band and said complementary security image band.

24. A security document as claimed in claim 20 wherein each of said image element cells define a series a primary diagonal axes and a series of corresponding rotated diagonal axes, wherein said rotated diagonal axes are defined by a rotation of said primary diagonal axes about a center of said image element cell;

individual ones of said first and second types of printed tiling elements comprise printed units positioned within said respective image element cells such that a number of printed units positioned along a selected primary diagonal axis differs from a number of printed units positioned along a corresponding rotated diagonal axis; and said first and second types of printed tiling elements are rotated relative to one another in the plane of the document face such that said primary diagonal axes of a first type of printed tiling element are aligned, along respective linear projections, with said rotated diagonal axes of a second type of printed tiling element.

* * * * *

UNITED STATES PATENT AND TRADEMARK OFFICE

CERTIFICATE OF CORRECTION

PATENT NO : 6,139,066

DATED : October 31, 2000

INVENTOR(S) : William Harvey Mowry, Jr. et al.

It is certified that error appears in the above-identified patent and that said Letters Patent are hereby corrected as shown below:

Column No. 11, line 22, add new paragraph, should read - - a first type of printed tiling element is printed in selected ones of said image element cells to define a printed security image within said security image area - - .

Column No. 12, line 28, "first type of" should read - - a first type of - - .

Signed and Sealed this

Eighth Day of May, 2001

*Attest:*

Nicholas P. Godici

NICHOLAS P. GODICI

*Attesting Officer*

*Acting Director of the United States Patent and Trademark Office*